United States Patent [19]

Schaller et al.

[11] Patent Number: 5,077,644

[45] Date of Patent: Dec. 31, 1991

[54] REFLECTOR FOR HAND HELD FLASHLIGHT

[75] Inventors: David R. Schaller, Janesville; El-Sayed Megahed, Madison, both of Wis.; Tor Pettersen, Peninsula, Calif.; Gregory L. Mills, Middleton, Wis.

[73] Assignee: Rayovac Corporation, Madison, Wis.

[21] Appl. No.: 517,836

[22] Filed: May 2, 1990

Related U.S. Application Data

[62] Division of Ser. No. 399,061, Aug. 25, 1989.

[51] Int. Cl.[5] ..... F21L 15/02; F21V 7/06

[52] U.S. Cl. ..... 362/184; 362/187; 362/208; 362/297; 362/346

[58] Field of Search ..... 362/184, 296, 297, 298, 362/341, 346, 347, 16, 804, 157, 202, 187, 188, 208

[56] References Cited

U.S. PATENT DOCUMENTS

| | | | |
|---|---|---|---|
| 344,532 | 6/1886 | Jones | 362/346 |
| 1,595,173 | 8/1926 | Stiert | 362/297 |
| 2,258,875 | 10/1941 | Arcas | 362/346 |
| 3,524,052 | 8/1970 | Troue | 362/346 |
| 4,194,234 | 3/1980 | Geissler | 362/346 |
| 4,229,782 | 10/1980 | Ruud et al. | 362/297 |
| 4,386,824 | 6/1983 | Draper | 362/346 |
| 4,422,134 | 12/1983 | Brass | 362/346 |
| 4,495,552 | 1/1985 | Graff | 362/346 |
| 4,504,888 | 3/1985 | Rosenthal | 362/346 |
| 4,605,993 | 8/1986 | Zelina, Jr. | 362/184 |
| 4,899,261 | 2/1990 | Blusseau et al. | 362/297 |

FOREIGN PATENT DOCUMENTS

| | | | |
|---|---|---|---|
| 2511380 | 9/1976 | Fed. Rep. of Germany | 362/346 |
| 3900910 | 7/1989 | Fed. Rep. of Germany | 362/346 |
| 0136775 | 10/1979 | Japan | 362/346 |

*Primary Examiner*—Ira S. Lazarus
*Assistant Examiner*—Richard R. Cole
*Attorney, Agent, or Firm*—Kenyon & Kenyon

[57] ABSTRACT

A hand held flashlight uses first and second light bulbs and first and second reflectors to generate a spot beam for illuminating distant objects and a flood beam for illuminating objects that are near. The first reflector is a parabolic reflector with the first light bulb being positioned at its focus to generate the spot beam. The second light bulb is positioned within the second reflector to produce the flood beam. A diffusing lens can be inserted in front of the second reflector to provide the appropriate divergence for the flood beam. The spot beam is preferably oriented at an angle relative to the axis of the flashlight for ease of use. The flashlight is designed so that the spot beam faces in a forward direction and the flood beam in a downward direction.

11 Claims, 6 Drawing Sheets

REFLECTOR FOR HAND HELD FLASHLIGHT

This is a division of application Ser. No. 07/399,061 filed Aug. 25, 1989, pending.

RELATED APPLICATION

This application relates to the flashlight disclosed in U.S. Design patent application Ser. No. 07/355,250, pending, filed May 22, 1989, incorporated herein by reference.

BACKGROUND OF THE INVENTION

The present invention relates to a hand held flashlight that can generate a spot beam for illuminating distant objects and a flood beam for illuminating near objects as well as to an economically designed flashlight that is capable of effectively exploiting both illumination beams.

A flashlight typically needs to illuminate either distant objects or things that are relatively close. A flashlight that is adapted for illuminating distant objects preferably has a narrowly focused spot beam. A flashlight designed for viewing near objects should have a flood beam to illuminate everything nearby. A spot beam is poorly suited for illuminating a nearby object because the intensity of the illumination is typically too great and the field of illumination is too narrow. Likewise, a flood beam is not suited for illuminating distant objects since the light is too diffuse at the object to illuminate it.

Known hand held flashlights typically generate either a spot beam for illuminating distant objects or a flood beam for illuminating everything nearby. One solution has been to provide a variable focus to the spot beam such that the spot beam can be defocused. A defocused spot beam, however, is not a good flood beam because the distribution of light is highly uneven. The conventional hand held flashlight simply does not provide for generating both spot and uniform flood beams. Attachments have been provided for diffusing the light from the spot beam to form a flood beam. Such attachments, however, are bulky and not practical since they require time to attach and are apt to be lost when separated from the flashlight.

Another solution has been to create a lantern comprising a spot beam and a fluorescent light source, as well as flashing amber light for highway distress. The lantern uses 6 D size batteries and includes a shoulder strap and an adapter for plugging into the cigarette lighter of an automobile. While it does generate both spot and flood beams, the lantern is too large to offer the versatility and ease of use of a conventional hand held flashlight.

The art has yet to produce a hand held flashlight that can generate both a spot beam and a uniform flood beam at the touch of a switch.

SUMMARY OF THE INVENTION

The present invention relates to a hand held flashlight with a switch that can change between a spot beam for illuminating distant objects and a flood beam for illuminating objects that are near. The invention attains this objective using a design that is ergonomic when held in one hand and stable when set in any of several resting positions.

The flashlight of the present invention can be implemented with first and second light bulbs and first and second reflectors. The first reflector is a parabolic reflector with the first light bulb being positioned at its focus to generate the spot beam. The second light bulb is positioned within the second reflector to produce the flood beam. A diffusing lens can be inserted in front of the second reflector to provide the appropriate divergence for the flood beam. The spot beam is preferably oriented at an angle relative to the axis of the flashlight for ease of use. The flashlight is designed so that the spot beam faces in one direction, such as forward, and the flood beam faces in another direction, such as downward. The spot beam can thus illuminate distant objects far in front whereas the flood beam can illuminate near objects on the ground. Moreover, the present invention is a hand held flashlight—a flashlight that can be operated with one hand. The spot beam and flood beam can be controlled with a single switch that is controlled by the thumb of the hand grasping the flashlight.

The present invention can be implemented in a flashlight that comprises two reflectors mounted in a slightly enlarged head. The first reflector is designed to point at a first angle, such as 45°, relative to the axis of the flashlight. The second reflector can point at a greater angle, such as 90°, relative to the axis of the flashlight. This inclination of the reflectors is ergonomically well suited for using the flashlight as a hand held lighting product. The flood beam is oriented at a sufficiently large angle that it can illuminate objects that are close to the user. The spot beam can be pointed at distant objects while the flashlight is grasped in the hand in a conventional manner. The ergonomics of the design are such that the flashlight is positionally stable when laid flat, on its back, on either side, or stood on end. A magnet and a hook can be provided for mounting the flashlight to adjacent surfaces. The stability of the flashlight when not held by the user is particularly helpful when using the flood beam because the flashlight can be set in place and thus free the user to work with both hands.

DETAILED DESCRIPTION

Figure 1:
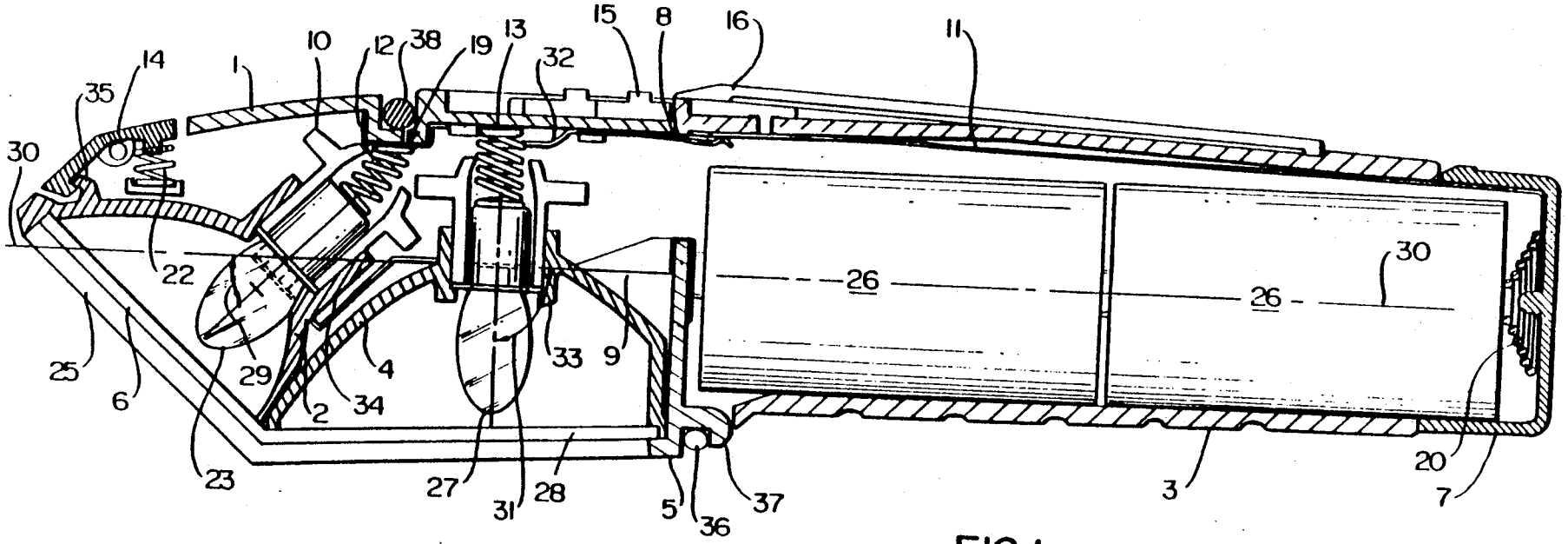
FIG. 1 shows a cross section flashlight according to the present invention that uses two light sources to create the spot beam and flood beam.

FIG. 1 shows a flashlight according to the present invention that uses separate light sources and separate reflectors to generate the spot beam and flood beam. The flashlight comprises a housing having a head 1 at its forward end, a body 3 which is formed as a hand grip and transparent window 25 having two portions, 6 and 28. The housing encloses two batteries 26. A spring 20 provides an electrical contact at cap 7 of the flashlight with battery contact 11. The battery contact 11 extends from spring 20 to switch contact 8 of switch 15. Spring contact 20 also presses the batteries 26 against bulb contact 9. A first bulb 23 and a second bulb 27 are always in contact with bulb contact 9. Bulb contact 9 extends from batteries 26 forward around and into base 33 of second bulb 27. The base of the second bulb 27 contacts the bulb contact 9 in a manner that is standard for commercial flashlights. Bulb contact 9 further extends forward to the base 34 of first bulb 23. Contact 9 again extends into the base and contacts the base of first bulb 23.

The filament of first bulb 23 is approximately at the focus of first reflector 2. The first reflector can be parabolic. Flood reflector 4 surrounds second bulb 27. Second bulb 27 may be positioned away from the focus of flood reflector 4 to produce the flood beam. Alternately, a diffusing lens 28 can be positioned in front of the flood reflector to produce the appropriate beam divergence, or a combination of both bulb positioning and diffusing lens may be used.

The orientation of the light bulbs and reflectors can be specified relative to axis 30 of housing 3. FIG. 1 shows that the first reflector 2 and first light bulb 23 are oriented at a first angle 29. Second light bulb 27 is likewise oriented at a second angle 31 relative to axis 30. The first angle 29 can be 45° and the second angle 90°. The inclination of the first light source is advantageous for aiming the flashlight when held in one hand. The design is ergonomically correct and thus reduces the steps placed on the user when using the flashlight.

The flashlight shown in FIG. 1 further comprises a window 6 for first reflector 2. The window can be from a transparent plastic. Latch 14 holds the window in position. The latch is held in place by a latch spring 22 which pivots latch 14 into a closed position. Latch 14 cooperates with a corresponding latch 35 on the first reflector 2 to keep the flashlight closed. Releasing latch 14 causes the flashlight to pivot about fastener 36. A latch 37 extends under fastener 36 to prevent the head of the flashlight from becoming disassociated during regular use. Releasing latch 14, however, enables the head of the flashlight to swing free. The first and second reflectors 2, 4, the first and second light bulbs 23, 27 and their associated mounts and connectors likewise swing free to give unobstructed access to the batteries. Removing the batteries permits access to switch contact 8 and switch 15.

The light bulbs are each mounted in a bulb retainer 10. A first bulb contact 12 is electrically connected to a contact strip 13 at joint 19 and electrically connected to a switch contact 8 of switch 15. A second bulb contact 32 electrically connects second bulb 27 to contact the strip 13 and to the switch contact 8. A magnetic mount 16 can be attached to housing 3 for supporting the flashlight. Transparent window 25 can be mounted in place using a sonic weld at bezel 5.

Figure 2:
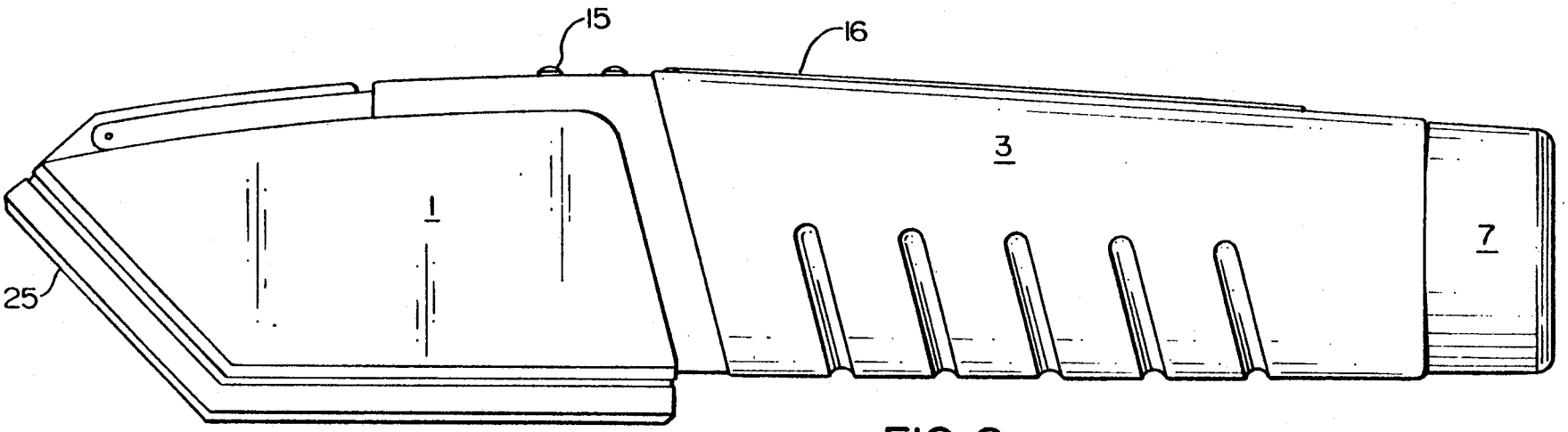
FIG. 2 shows a side view of the exterior of the flashlight shown in FIG. 1.
Figure 3:
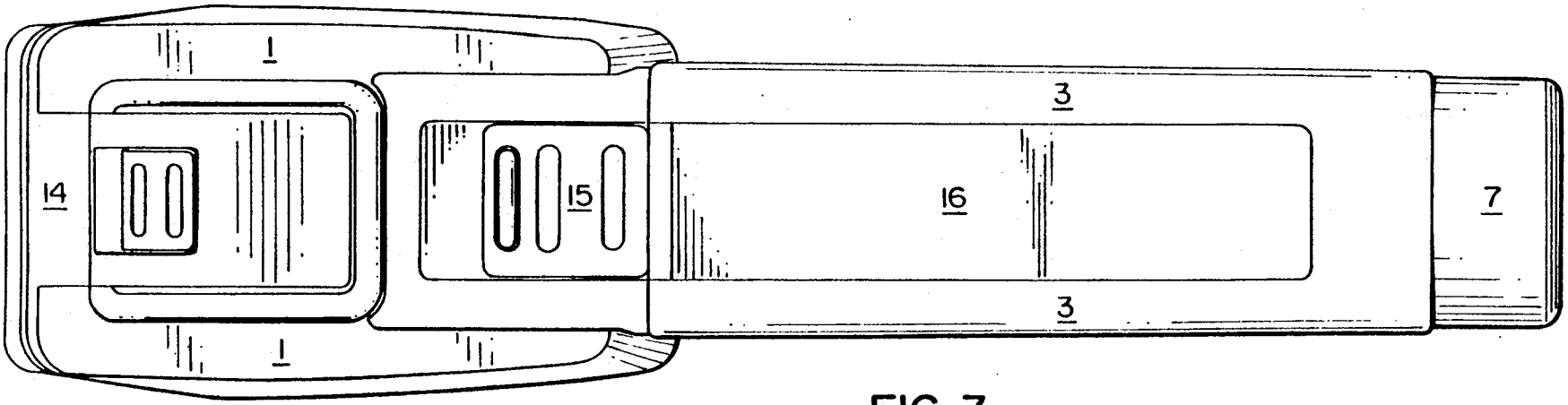
FIG. 3 shows a top view of the flashlight shown in FIG. 2.
Figure 5:
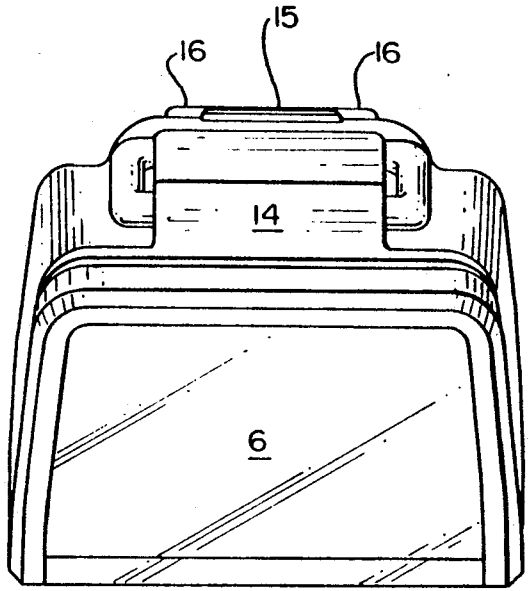
FIG. 5 shows a front view of the flashlight shown in FIG. 2.
Figure 4:
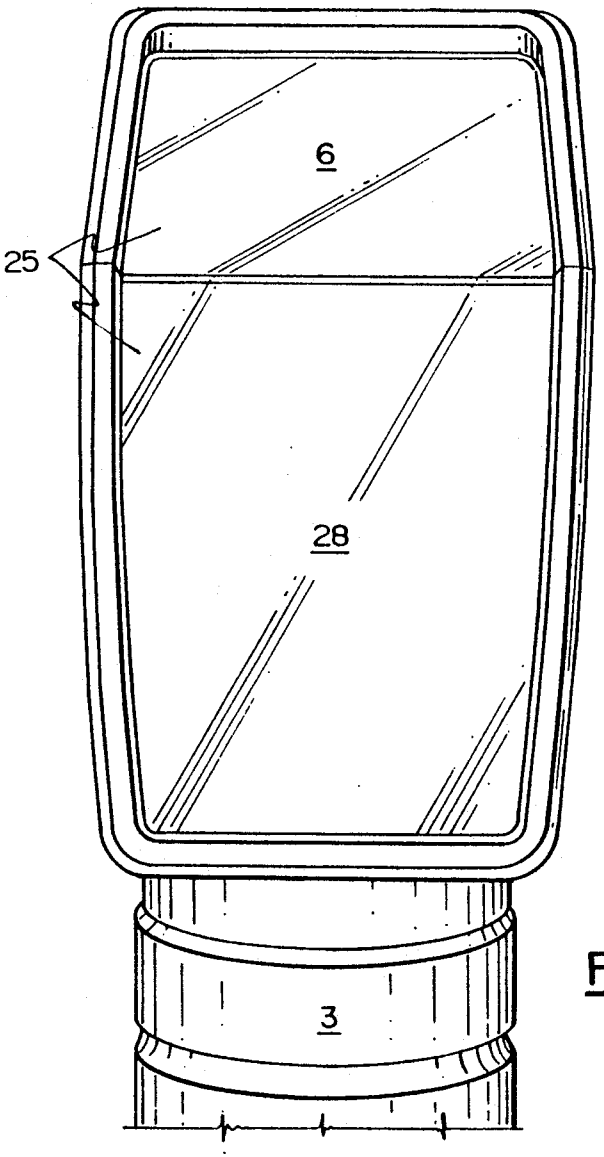
FIG. 4 shows a bottom view of the head of the flashlight shown in FIG. 2.

FIGS. 2 and 3 show a side view and a top view, respectively, of the exterior of the flashlight shown in FIG. 1. FIGS. 4 and 5 show a bottom view and front view, respectively, of the flashlight shown in FIGS. 1-3. The head 1 is noticeably enlarged from body 3 to accommodate the first and second reflectors just as a conventional hand held flashlight is also larger at its forward end to accommodate its one reflector. The enlarged head of the flashlight shown in FIGS. 2 and 3, however, extends further back to accommodate the second reflector. The enlarged head adds stability to the flashlight when it is not being held.

The flashlight shown in FIG. 1 has several operating positions which are stable when not being physically held in the hand of the user. The bottom side of head 1 presents a large, flat surface that discourages the flashlight from rotating, unlike a conventional round flashlight. Further, the weight of the flashlight is distributed such that it can rest upright on end cap 7. A ring 38 is also provided for hanging the flashlight on a hook. As shown in FIG. 3, the ring 38 fits within a groove on the outside of the top of head 1 in its retracted position. The ring is pivotally mounted to the head so that it can be swung up for use.

A magnet !6 is attached to body 3 for mounting the flashlight to a ferromagnetic surface. The magnet generates sufficient attractive force to mount the flashlight to a vertical ferromagnetic surface. The magnet can also suspend the flashlight horizontally from an overhanging ferromagnetic surface even when the flashlight contains a full set of batteries. The magnetic strip 16 permits the flashlight to be conveniently mounted in locations where the flood reflector can be put to optimal use. Ring 38 also allows the flashlight to hang on a hook on a surface that is not magnetic. In any event the flashlight can always be stood on end 7. Any of these modes of use allow the flood beam to obtain on optimal position for use in illuminating nearby objects. This construction of the flashlight is to be contrasted with that of the conventional flashlight which is most stable when resting on a surface only when stood on its head where the spot beam does no good, which rolls around when placed on its side, and which, when not being held, can reliably direct its spot beam only straight up where it usually does little good.

The ergonomic design of the flashlight combines with its dual spot/flood beams and its stability when resting to produce a lighting product that is both versatile and practical. The ergonomically designed handle facilitates viewing objects that are distant, whereas the end cap 7, magnet 16 and ring 38 facilitate positioning the flashlight in optimal position for close-in work using the flood beam. Further, the flashlight does not roll when positioned on a table due to the large, flat surface projected downward by head 1. It is to be noted that the head 1 stabilizes the flashlight in 3 positions only. The head 1 is completely suspended when the flashlight lies on its back. However, even when on its back the flat magnetic strip 1 stabilizes the flashlight and prevents it from rolling. The flood beam can thus point upward from a stable position also.

Figure 6:
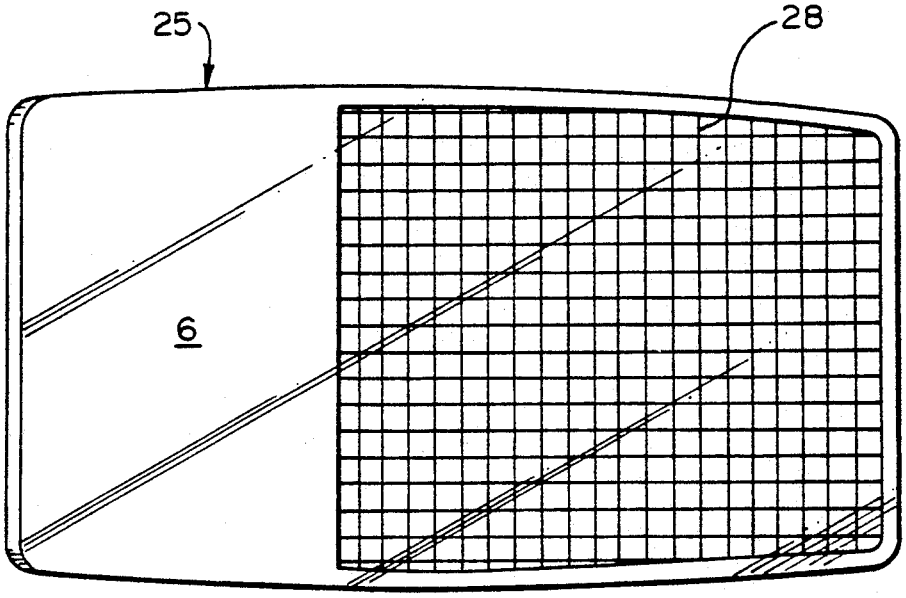
FIG. 6 shows a transparent window for the flashlight shown in FIGS. 1 and 2.
Figure 7:
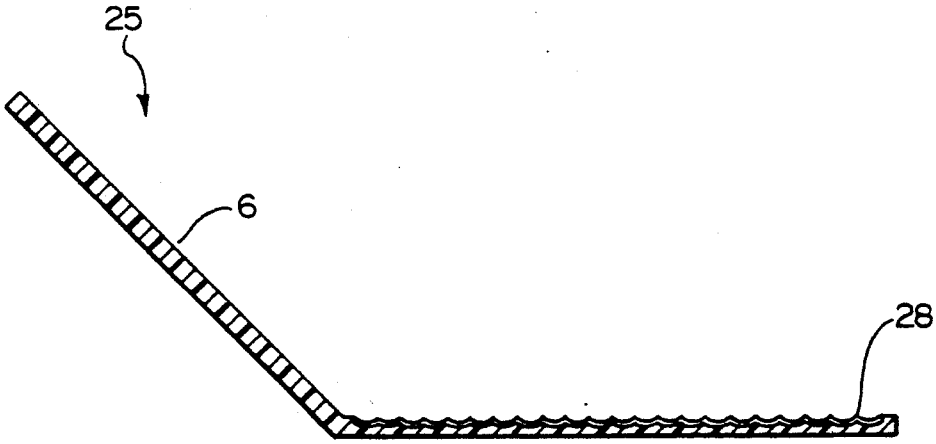
FIG. 7 shows a cross section of the transparent window shown in FIG. 6.
Figure 8:
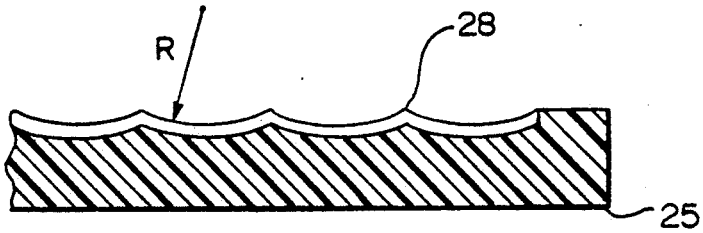
FIG. 8 shows an enlarged cross section of the diffusing area of the transparent window.

FIGS. 6-8 show the construction of transparent window 25. Window 6 and diffusing lens 28 are shown in their respective positions on the transparent window. The cross sections shown in FIGS. 7 and 8 illustrate that the diffusing plate comprises a matrix of concave lenslets with radius R. This array of negative lenses diffuses the light in a more controlled manner than obtained using a diffusion coating. The combination of the parabolic flood reflector 4 and the matrix of concave lenslets on diffusing lens 28 creates a substantially square flood beam.

Figure 10:
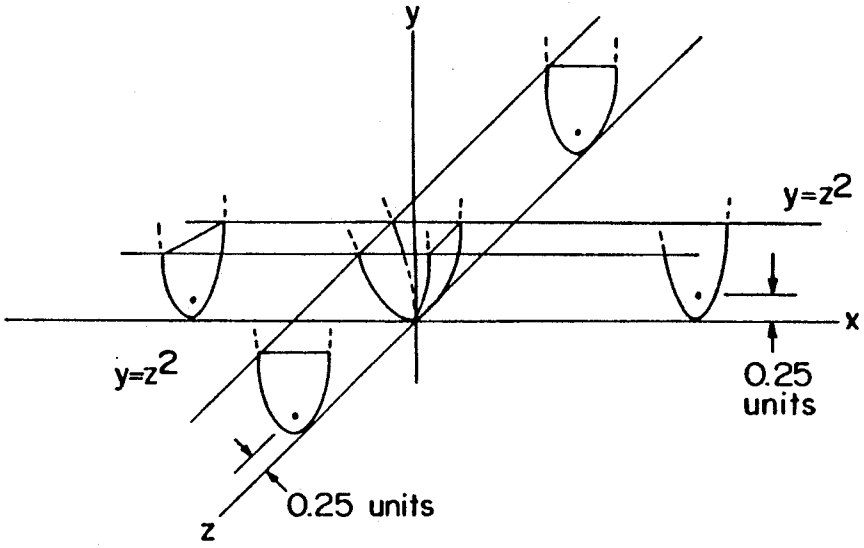
FIG. 10 illustrates the translation of the parabolas shown in FIG. 9.
Figure 9:
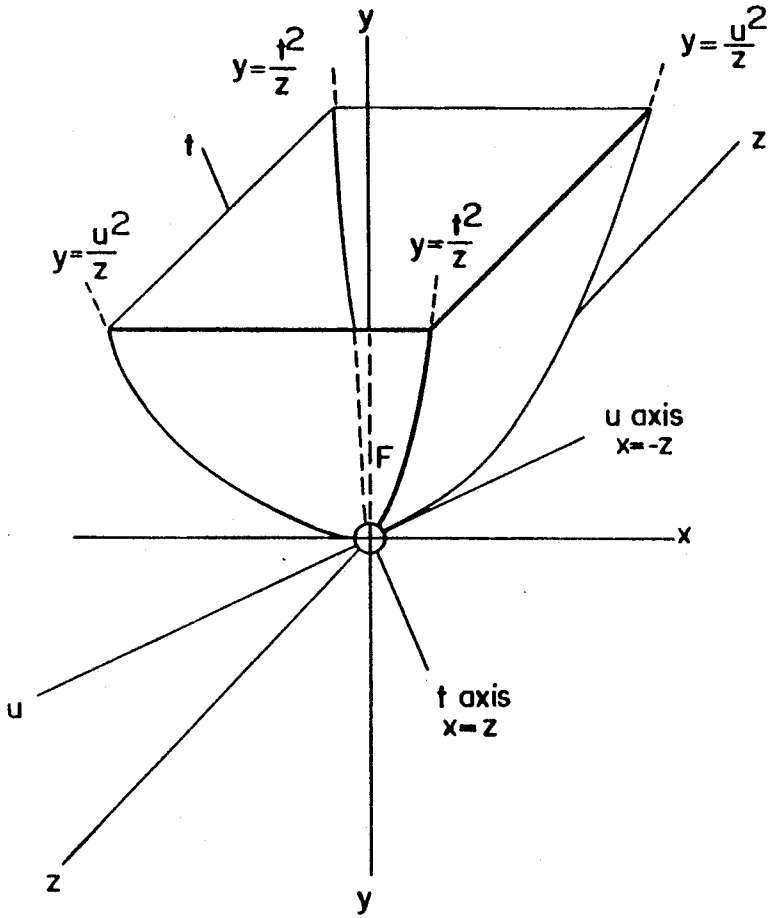
FIG. 9 shows an alternative embodiment of a reflector for the creating of a flood beam in the flashlight shown in FIG. 1 using a reflector that has a reflecting surface corresponding to the intersection of parabolas after the parabolas are translated along orthogonal axes.
Figure 11:
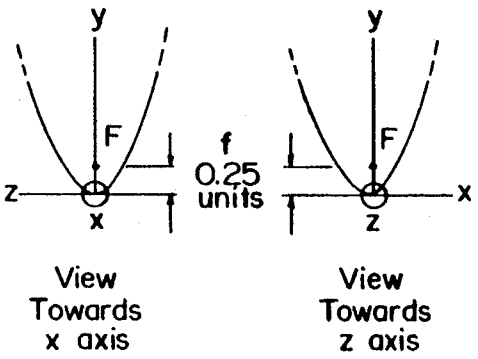
FIG. 11 illustrates the parabolas that are translated in FIG. 10.
Figure 12:
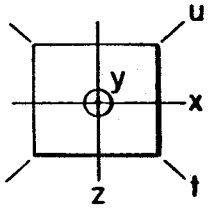
FIG. 12 is a top view of the reflector shown in FIGS. 9 and 10.

FIG. 9 shows an alternative embodiment of the flood reflector 4 that can be used in the flashlight of the present invention. The reflector is formed from the surface formed by translating two intersecting parabolas (TIP) along orthogonol axes such as the x - y axis of a Cartesian coordinate system as shown in FIG. 10. The TIP reflector represents the intersection of the surfaces generated by translating two parabolas along the orthogonol axis shown in FIG. 11. The reflecting surface is formed from that region where the parabolas intersect. The four reflection surfaces of the TIP reflector can have, for example, a curvature determined by parabolas of the form $-x^2=y=z^2$ where z is an axis normal to the x - y plane. The axes of the parabolas meet at the origin of the coordinate system and form the square reflector shown in FIG. 12.

Figure 13:
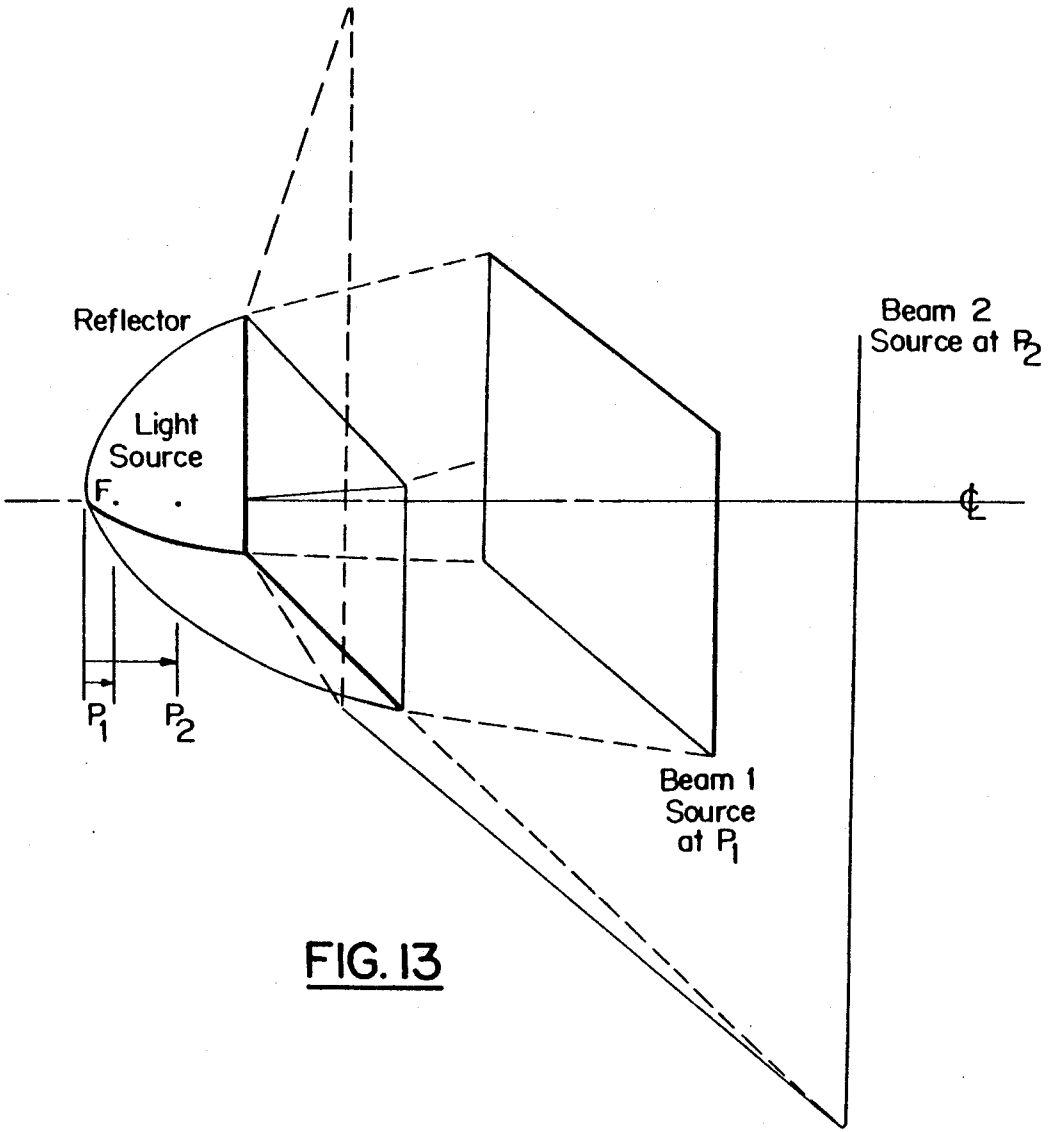
FIG. 13 illustrates the affect on the illumination pattern of a change in bulb position.

The reflected light in the TIP reflector does not undergo multiple reflections. A bulb having a filament positioned at the focus thus generates a square beam that is remarkably uniform in illumination and that spills very little light which results in a very sharp cut-off of the light around the edges of the reflector. Moreover, the shape of the beam, the sharpness of the edge cut-off and the uniformity of the illumination are all present when the bulb moves away from the focus. The square beam remains substantially square, sharply defined and uniformly illuminated. The principal change in the illumination pattern is that the beam diverges faster. FIG. 13 shows how a small change in the bulb position results in a dramatic change in the size of the illumination pattern. In this way the divergence of the flood beam is more easily controlled. This simple control of the beam divergence is to be contrasted with a diffusing lens or conventional reflector in which a change in the beam divergence requires reconfiguring the curvature of the lens or mirror or else accepting an uneven illumination pattern from a defocused optical system.

The operation of the flashlight disclosed above is relatively simple. A person holds the body 3 with one hand. The flashlight body is ergonomically designed for this purpose. Switch 15 can be controlled using the thumb to change the flashlight between an off condition, a flood beam, and a spot beam. The first position of the switch represents an off position. It is located at the position nearest the end cap 7 of the flashlight. The intermediate position connects switch contact 8 to contact strip !3 and to the second bulb contact 32. The forward position of switch 15 connects switch contact 8 and contact 19 to first bulb contact 12. The contact with second bulb contact 32 is broken so that only one bulb draws power from the batteries at a time. The power of the batteries is conserved by illuminating only one lamp at a time; dual (spot and flood) operation is feasible with appropriate lamp and switch design.

The principles, preferred embodiments and modes of operation of the present invention have been described in the foregoing specification. The invention which is intended to be protected herein should not, however, be construed as limited to the teachings of the specification because they merely illustrate the invention. There should be other ways to practice the present invention that will come within the meets and bounds of the inventions identified in the following claims as well as within the penumbra of the invention they define.

What is claimed is:

1. A hand held flashlight comprising a reflector which produces an illumination pattern from a light source which is substantially the shape of the reflector, wherein the reflector has four reflecting surfaces defined by an intersection formed by translating two intersecting parabolas along orthogonal intersecting axes, whereby said reflector is a flood beam reflector for said hand held flashlight.

2. The hand held flashlight as claimed in claim 1, wherein the reflecting surfaces place a focus away from the lighting source.

3. The handheld flashlight as claimed in claim 1, wherein the illumination pattern is substantially uniform.

4. The handheld flashlight of claim 1, wherein divergence of the illumination pattern can be varied by changing the location of the light source.

5. The reflector as claimed in claim 4, wherein the reflecting surfaces place a focus away from the light source.

6. The reflector as claimed in claim 4, wherein the orthogonal axes are the x and y axes of a Cartesian coordinate system, and the parabolas are defined normal to the x - y plane along a z axis by the equation $x^2=y=z^2$.

7. The hand held flashlight as claimed in claim 1, wherein the orthogonal axes are the x and y axes of a Cartesian coordinate system, and the parabolas are defined normal to the x - y plane along a z axis by the equation $x^2=y=z^2$.

8. A reflector for producing an illumination pattern from a light source which is substantially the shape of the reflector, wherein the reflector comprises four reflecting surfaces defined by an intersection formed by translating two intersecting parabolas along orthogonal intersecting axes, wherein divergence of the illumination pattern can be varied by changing the location of the light source.

9. The reflector as claimed in claim 8, wherein the illumination pattern is substantially uniform.

10. A hand held flashlight comprising:

a body having a hand grip and a principal axis;

a switch mounted on the body near the hand grip for operating the flashlight, the switch having contacts for turning the flashlight off and for operating the flashlight in at least first and second modes;

a first light bulb having a first filament, the first light bulb being connected to the contacts of the switch for operating the flashlight in at least the first mode;

a first reflector having a first focus, the first filament being positioned substantially at the first focus for forming a spot beam;

a second light bulb having a second filament, the second light bulb being connected to the contacts of the switch for operating the flashlight in at least the second mode; and a second reflector positioned at an angle relative to the principal axis of the flashlight so as to project light form the second filament away from the principal axis, the second reflector substantially surrounding the second filament for forming a flood beam, and wherein the second reflector comprises four reflecting surfaces that are defined by the intersection formed by translating two intersecting parabolas along orthogonal intersecting axes.

11. A hand held flashlight as claimed in claim 10, wherein orthogonal axes are the x and y axes of a Cartesian coordinate system, and the parabolas are defined normal tot he x - y plane along a z axis by the equation $x^2=z=y^2$.

* * * * *

UNITED STATES PATENT AND TRADEMARK OFFICE

CERTIFICATE OF CORRECTION

PATENT NO. : 5,077,644

DATED : December 31, 1991

INVENTOR(S) : David R. Schaller et al

It is certified that error appears in the above-identified patent and that said Letters Patent is hereby corrected as shown below:

IN THE TITLE PAGE

Under "[75] Inventors:" Delete "Tor Pettersen, Peninsula, Calif.;".

| Column | Line | |
|---|---|---|
| 2 | 41 | After "section" insert --of a--. |
| 3 | 1 | Change "affect" to --effect--. |
| 4 | 27 | Change "!6" to --16--. |
| 5 | 11 | Change "orthogonol" to --orthogonal--. |
| 5 | 15 | Change "orthogonol" to --orthogonal--. |
| 5 | 19 | Change "$-X_2$" to -- $X_2$ --. |
| 5 | 53 | Change "!3" to --13--. |
| 6 | 15 | Change "handheld" to --hand held--. |
| 6 | 18 | Change "handheld" to --hand held--. |
| 6 | 63 | Change "form" to --from--. |

UNITED STATES PATENT AND TRADEMARK OFFICE

CERTIFICATE OF CORRECTION

PATENT NO. : 5,077,644

DATED : December 31, 1991

INVENTOR(S) : David R. Schaller et al

It is certified that error appears in the above-identified patent and that said Letters Patent is hereby corrected as shown below:

Col. 8, line 2, change "tot he" to --to the--.

Signed and Sealed this

Sixteenth Day of March, 1993

*Attest:*

STEPHEN G. KUNIN

*Attesting Officer*

*Acting Commissioner of Patents and Trademarks*